United States Patent [19]

Grillo

[11] 4,134,558

[45] Jan. 16, 1979

[54] BRAKE CONSTRUCTION FOR CLOTH-LAYING MACHINE

[75] Inventor: Joseph A. Grillo, East Islip, N.Y.

[73] Assignee: Cutting Room Appliances Corporation, Hicksville, N.Y.

[21] Appl. No.: 817,682

[22] Filed: Jul. 21, 1977

[51] Int. Cl.[2] ..... B65H 25/22; B65H 23/06

[52] U.S. Cl. ..... 242/75.43; 242/75.4

[58] Field of Search ..... 242/75.43, 75.2, 156.1, 242/75.44, 75.4, 74

[56] References Cited

U.S. PATENT DOCUMENTS

| | | | |
|---|---|---|---|
| 2,343,181 | 2/1944 | Heinz | 242/75.43 |
| 2,436,067 | 2/1948 | Fonda | 242/75.2 X |
| 3,140,359 | 7/1964 | Rupard | 242/75.41 X |
| 3,275,264 | 9/1966 | Crow | 242/156.1 X |
| 3,310,254 | 3/1967 | Merrill | 242/75.4 |

*Primary Examiner*—Edward J. McCarthy
*Attorney, Agent, or Firm*—Joseph P. Gastel

[57] ABSTRACT

A brake construction for braking a roll of fabric journalled on a cloth-laying machine having first and second spaced frame portions, said brake construction including a brake band having a first end portion anchored to the first portion of the frame by a spring arrangement, and a second end portion attached to a wind-up roller mounted on the second portion of the frame, with an intermediate brake band portion therebetween lying in contiguous relationship to the surface of the fabric roll, a motor for selectively winding the wind-up roller to cause the intermediate brake band portion to press against the outer surface of the fabric roll to thereby effect braking thereof, the motor being actuated by a dancer bar actuated switch, or a reversal switch for the cloth-laying machine, or a switch which is responsive to excessive slack in the brake band, and a time delay switch for causing the motor to be energized for a predetermined time period each time it is actuated. In one embodiment, when the motor is deenergized, the spring arrangement loosens the brake band so that it exerts no braking force. In another embodiment, a limited unwind mechanism is associated with the wind-up roller to provide limited unwinding under the bias of the spring arrangement after the motor is deenergized to thereby maintain a drag on the roll which is smaller than the braking force experienced when the motor is energized.

46 Claims, 20 Drawing Figures

BRAKE CONSTRUCTION FOR CLOTH-LAYING MACHINE

BACKGROUND OF THE INVENTION

The present invention relates to an improved brake construction for a cloth-laying machine.

By way of background, cloth-laying machines are commonly used whenever layers of cloth have to be deposited on a table for subsequent cutting. These machines carry a roll of cloth which, when full, may weigh anywhere between 500 and 1,000 pounds, and the roll may be unwound at a linear speed of up to 300 feet per minute. However, depending on conditions which the machine is experiencing, such as slowdown or reversal, the roll must be braked in order to match its linear unwinding speed to the speed of the machine on the table. In the past various types of brakes have been used, none of which could provide the necessary braking to the cloth roll. In this respect, one type of prior brake comprised a disc brake secured to the mandrel on which the roll was mounted. This brake was deficient for two reasons. Firstly, it operated close to the center of the cloth roll and therefore did not have a sufficiently large lever arm to produce effective braking. Secondly, the roll of cloth could continue to rotate after braking, considering that the only connection between the cardboard roll on which the roll was wound and the mandrel was through a series of teeth. Whenever there was slippage between the teeth and the cardboard roll, the latter would get ruined and even possibly the cloth could get torn. If there was no slippage between the teeth and the cardboard roll, there was still the possibility that the roll of cloth would not stop unwinding if it was not securely fastened to the cardboard roll, which was a common occurrence. Another type of brake arrangement used with cloth-laying machines was the type associated with braked rollers on which the outer periphery of the cloth roll rested. However, this type of braking was also deficient in that there was only line contact between the cloth roll and the supporting rollers therefor. This line contact, in addition to not providing a large braking surface, also caused undesirable indentations on the roll of cloth. In addition to the foregoing, it was known to lay a web across the roll of cloth with one end of the web anchored to the frame and the other end carrying a weight. This was deficient because it could not apply acute braking as needed.

SUMMARY OF THE INVENTION

It is accordingly one object of the present invention to provide an improved braking system for a cloth-laying machine in which the cloth roll may be braked by the application of a band-braking force to the outside surface of the roll in response to a plurality of conditions including slack in the material being unwound from the cloth roll, slowdown of the machine at reversal thereof, and excessive slack in the brake band.

It is another object of the present invention to provide an improved braking system for a cloth-laying machine in which the duration of the braking may be adjusted for different conditions of operation.

Another object of the present invention is to provide an improved braking system for a cloth-laying machine in which a small controlled amount of drag is provided by the brake band after the termination of primary braking, so that the drag produced by the brake band will prevent the cloth roll from speeding up undesirably.

It is still another object of the present invention to provide an improved braking system for a cloth-laying machine in which the brake band is automatically tensioned toward the roll of cloth in the event that excessive slack is experienced in the brake band, thereby assuring that the brake band tends to be maintained in a dragging relationship to the roll of cloth.

Other objects of the present invention will readily be perceived hereafter.

The improved brake construction for braking a roll of cloth on a cloth-laying machine comprises a machine frame having first and second frame portions spaced circumferentially of said roll, brake band means having first and second spaced band portions with an intermediate band portion therebetween, first means for attaching said first band portion to said first frame portion, second means for attaching said second band portion to said second frame portion, and motor means for selectively moving said intermediate band portion against said roll to effect braking thereof. The brake band is actuated when there is too much slack in the cloth leaving the roll or when the machine slows down at reversal. In addition, the brake band may be actuated when there is too much slack in the brake band itself. Furthermore, means are provided for causing the brake band to be actuated for a predetermined time period. In one embodiment, means are provided for relieving the brake from braking contact with the cloth roll after expiration of the predetermined time period. In another embodiment, means are provided for maintaining a limited amount of drag by the brake band on the cloth roll after the second means, which provide a primary braking force, have been deenergized. The various aspects of the present invention will be more fully understood when the following portions of the specification are read in conjunction with the accompanying drawings wherein:

DESCRIPTION OF THE PREFERRED EMBODIMENTS

Figure 1:
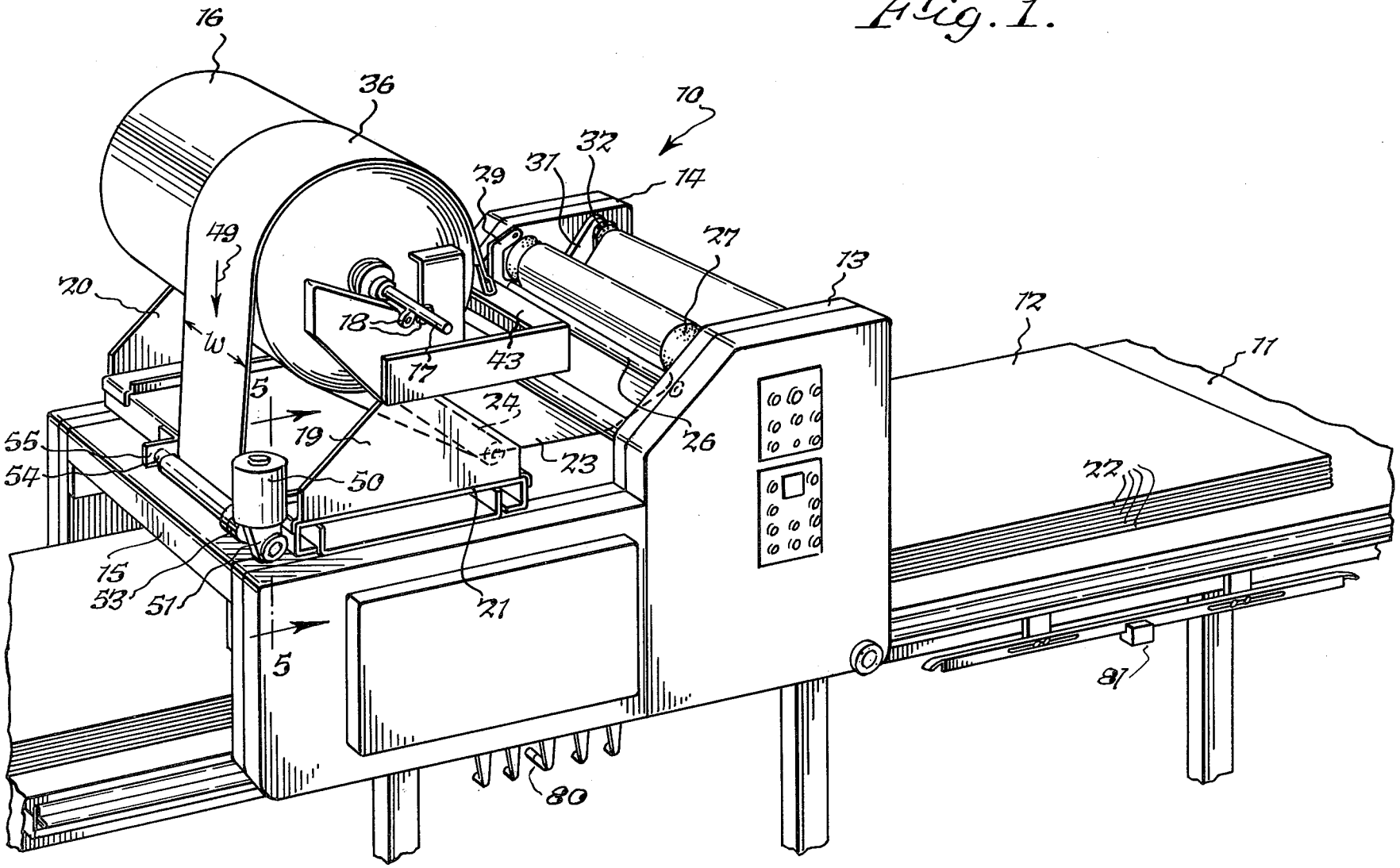
FIG. 1 is a fragmentary perspective view of a cloth-laying machine mounting the improved brake construction of the present invention.
Figures 2, 3:
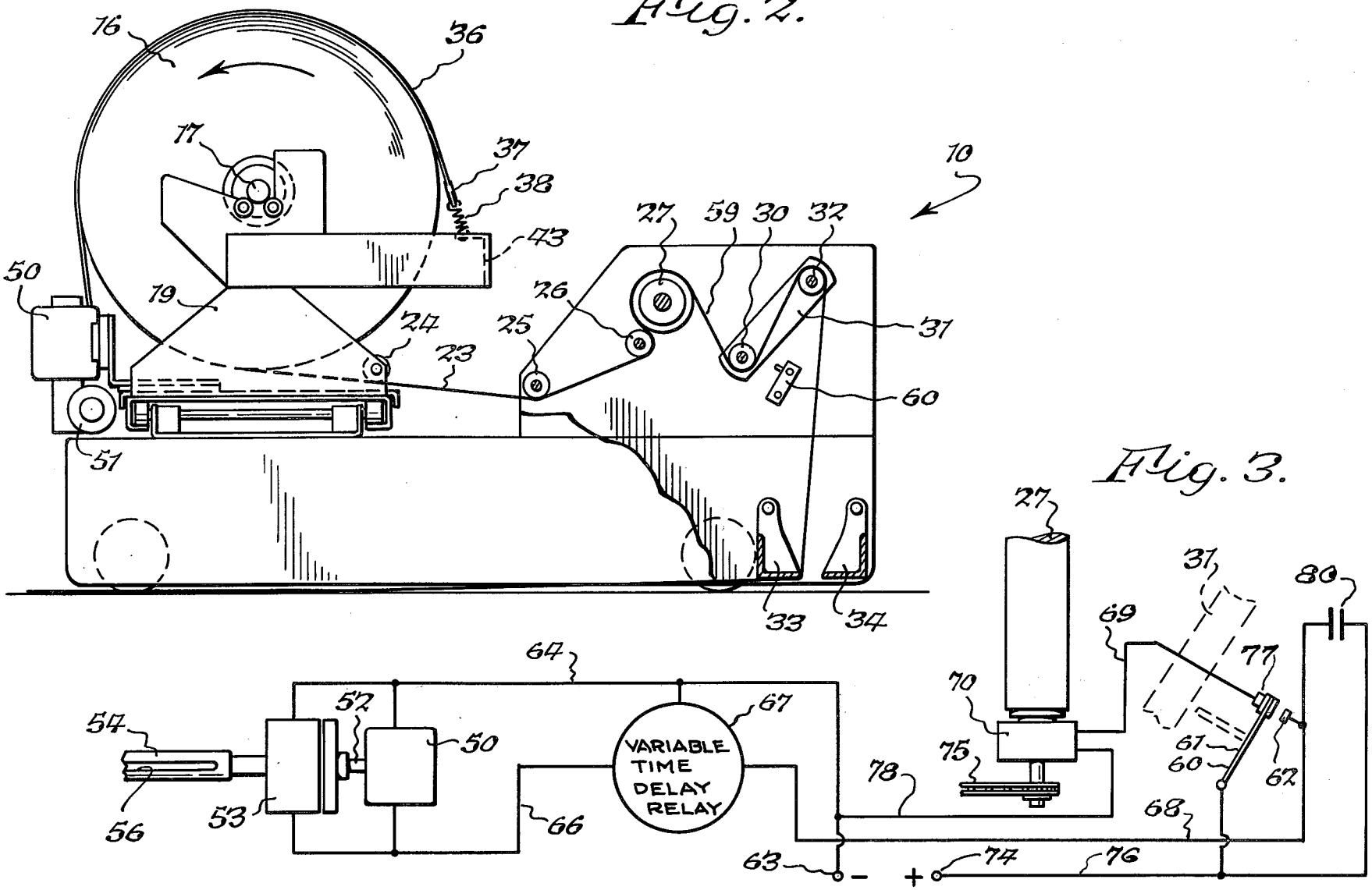
FIG. 2 is a schematic cross sectional view, partially broken away, showing the improved brake construction and also showing other related parts of the cloth-laying machine.
FIG. 3 is a schematic wiring diagram for the brake mechanism and associated portions of the cloth-laying machine.
Figures 4, 5, 6, 7:
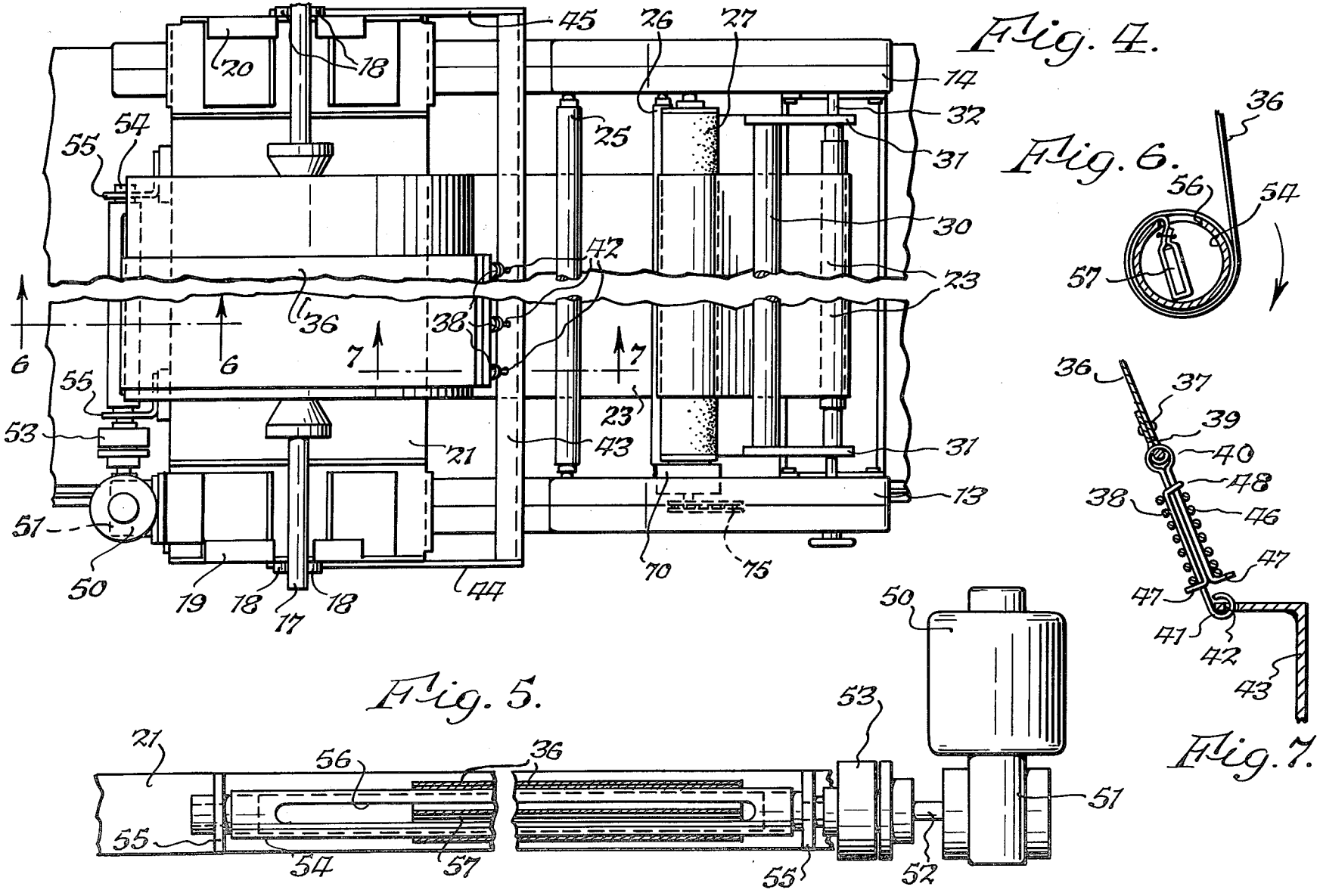
FIG. 4 is a fragmentary plan view of the improved brake construction and related portions of the cloth-laying machine.
FIG. 5 is a fragmentary view, partially in cross section, taken substantially along line 5—5 of FIG. 1 and showing particularly the construction of the wind-up roller.
FIG. 6 is a fragmentary cross sectional view taken substantially along line 6—6 of FIG. 4 and showing the wind-up roller in cross section.
FIG. 7 is a fragmentary cross sectional view taken substantially along line 7—7 of FIG. 4 and showing the spring anchoring structure for the fixed end of the brake band.

By way of broad background, the improved brake construction is mounted on a cloth-laying machine 10 which moves back and forth on cloth-laying table 11 in the conventional manner to lay out layers of cloth 12 for subsequent cutting. Machine 10 includes opposed side frames 13 and 14 which are interconnected by a plurality of cross frame members, such as 15, only one of which is shown in the interest of simplicity. A roll of cloth 16, which may weigh as much as 1,000 pounds, is mounted on a mandrel 17 supported on antifriction bearings 18 mounted on standards 19 and 20 which have their lower ends secured to edge control platform 21 which is mounted for transverse movement relative to the direction of motion of the cutting machine to maintain the edges 22 of the cloth in a straight line. As the web 23 is played out from roll 16 (FIG. 2), it will pass under idler roller 24, which is journalled between standards 19 and 20, under idler roller 25, which is journalled between frame sides 13 and 14, around wrap roller 26 which is mounted between a pair of arms such as 29 suspended from frame portions 13 and 14, around positive drive feed roller 27, underneath dancer bar roller 30 which is journalled between the lower ends of a pair of arms 31, the upper ends of which are affixed to shaft 32 which is journalled for pivotal movement in side frame members 13 and 14, and thereafter between tuck bar blades 33 and 34 from whence it is laid on the table.

As indicated above, the roll of fabric 16 may weigh as much as 1,000 pounds. The laying machine 10 may travel as fast as 300 feet per minute which means that the linear speed of cloth being unwound at the periphery of roll 16 must equal this amount. When it is considered that roll 16 may weigh as much as 1,000 pounds, it will be appreciated that the cloth roll rotates with a relatively high momentum and therefore there must be a relatively large braking force applied to roll 16 in order to control it properly. This braking force must be applied at machine reversal, that is, when the machine reaches the end of the table and must reverse itself, and this braking must also be applied periodically during normal movement of the machine on the cloth-laying table when more cloth is being played out from the roll than is actually being laid on the table.

One embodiment of the improved brake mechanism of the present invention for providing effective braking in a highly expedient manner without the shortcomings of prior braking systems is shown in FIGS. 1–7. In this embodiment there is provided a band 36 of flexible material, such as plastic or woven cloth fabric, which has a first end portion 37 (FIG. 2) secured to a plurality of spring units 38 which are spacedly secured across its width. In this respect, a plurality of apertures, such as 39 (FIG. 7), are provided in end 37 and the bracket portion 40 of each spring unit 38 is threaded through an aperture 39. The other end of each spring unit 38 terminates at a looped bracket portion 41 which is received in an aperture 42 in an anchoring frame member 43 which is rigidly secured to standards 19 and 20 by arms 44 and 45, respectively. The remainder of spring unit 38 comprises a coil spring 46 having one end which bears on feet 47 of bracket portion 40 and the other end of which bears on portion 48 of bracket 41. It will be appreciated that as band 36 is pulled upwardly in FIG. 7, the accompanying upward movement of bracket portion 40 will cause spring 46 to be compressed.

In order to periodically exert a braking force on roll 16 by moving band 36 in the direction of arrow 49 (FIG. 1) a motor 50 is suitably mounted on edge control platform 21. A gear reducer 51 receives the output from motor 50 and in turn through gear reducer output shaft 52 transmits this motion to clutch 53, the other end of which is coupled to slotted shaft or wind-up roller 54 which is journalled in brackets 55 suitably mounted on the frame of edge control platform 21. A longitudinal slot 56 in roller 54 selectively receives an elongated bar 57 (FIG. 6) attached to the end of band 36 and which is substantially the width of band 36. It will be appreciated that the slot and bar arrangement 56–57 permits the end of band 36 to be threaded into the slot 56 of roller 54 and to be removed therefrom in an expedient manner. In this respect it will be appreciated that the end of band 36 must be removed from roller 54 when a new roll of cloth 16 is being mounted on standards 19 and 20.

As noted briefly above, during certain times of machine operation, it is necessary to brake roll 16 and this is achieved by pulling band brake 36 in the direction of arrow 49. More specifically, during machine operation there will be times when loop 59 (FIG. 2) becomes sufficiently long so that arm 31 will engage switch 60 which is mounted on the side frame of the machine. This means that cloth is being unwound from roll 16 at a greater speed than it is being laid on the table, which, in turn, necessitates braking of roll 16. Accordingly, arm 31 will move arm 61 of switch 60 clockwise from the position shown in FIG. 3 to engage contact 62. This will complete a circuit from the negative terminal 63 through lead 64, motor 50 and clutch 53, lead 66, time delay relay 67, lead 68, contact 62, switch arm 61 and lead 76 to the positive terminal 74. The completion of the foregoing circuit will cause the wind-up roller 54 to wind up brake band 36 to thereby apply a band braking force to cloth roll 16. When contact 77 is out of engagement with switch arm 61, current to clutch 70 of feed roll 27 will be disrupted, whereby there will be no drive from chain 75 to roll 27, so that roll 27 will not work against the brake. After a suitable time delay, as determined by time delay relay 67, the braking circuit will be deenergized, that is, flow of current to motor 50 and clutch 53 will be terminated, regardless of the position of switch arm 61. After arm 61 returns to the solid line position of FIG. 3, clutch 70 will be reenergized because a circuit will be completed from terminal 63 through lead 78, clutch 70, lead 69, switch arm 61, and lead 76 to terminal 74. If switch arm 61 reengages contact 77 before variable time delay relay 67 terminates flow of current to motor 50 and clutch 53, there may be a slight overlap period wherein feed roll 27 is driven while braking is being effected.

It will thus be appreciated that when the dancer bar actuates switch 60, brake motor 50 and clutch 53 will be actuated to rotate wind-up roller 54 in a direction so as to tension brake band 36 in the direction of arrow 49 to thereby apply a braking force on cloth roll 16. However, in view of the action of time delay relay 67, the braking force will be effective only for a predetermined period of time, and thereafter it will automatically release. This time period can be anywhere from a fraction of a second to about three seconds or more, depending on the setting of delay relay 67 because of the fact that time delay relay 67 is adjustable. As noted above, whenever motor 50 and clutch 53 are initially energized, feed roll clutch 70 will be deenergized so as to terminate the driving relationship between chain 75 and roller 27 so that the feed roller 27 is not working against the brake at this time. It is to be noted that clutch 53 is preferably of the magnetic type, the torque of which can be adjusted by varying the voltage thereto, so that the torque can be adjusted for different materials or operating conditions.

The slow-down microswitch 80 is also operative at the end of carriage travel, that is, slightly before reversal of carriage movement, to effect braking of cloth roll 16 by energizing the motor 15 and clutch 53 and deenergizing clutch 70, as described above relative to the dancer bar actuated switch 61. In this respect, closing of switch 80 when its switch arm (FIG. 1) engages cam 81 will energize motor 50, clutch 53, and variable time delay relay 67, and also, through a suitable switch (not shown) will deenergize clutch 70. In the foregoing respect, the closing of switch 80 (FIG. 3) will complete the same circuit through time delay relay 67, motor 50 and clutch 53 as described above relative to the movement of switch arm 61 into engagement with contact 62 because switch 80 is in parallel with switch arm 61 and contact 62. In addition, the suitable switch (not shown) mentioned above is a normally closed switch in lead 78 which is opened by the same action which results in the closing of switch 80, to thereby provide the same action as described above when switch arm 61 moves out of engagement with contact 77 and into engagement with contact 62.

It will be appreciated that as more and more fabric or cloth is removed from roll 16, it will decrease in diameter. However, this will have no bearing on the operation of the brake because excess fabric from band 36 will be wound up on wind-up roller 54.

At this point it is to be noted that clutch 53 includes mechanism which will permit it to slip when sufficient resistance is encountered, that is, after a predetermined torque has been experienced. This torque is encountered after springs 46 have been fully compressed. Otherwise, band 36 could be torn or motor 50 could burn out or excessive braking force could be applied to roll 16. After clutch 53 and motor 50 have been deenergized by time delay relay 67, clutch 53 will release to permit springs 46 to expand to thereby loosen brake band 36 because, as a result of the release of clutch 53, wind-up roller 54 will be permitted to rotate in a direction opposite to the direction in which it was rotated by motor 50. Furthermore, since the clutch 53 will be deenergized instantaneously, spring units 38 will expand instantaneously to thereby tend to pull a sufficiently great amount of the band 36 off wind-up roller 54 to insure the required looseness of the band on cloth roll 16.

At this point it is to be noted that brake band 36 has a width W. By selectively installing bands with different widths, different braking forces can be applied to a cloth roll 16. In this respect, by making the band wider, a greater braking force can be applied, and by making it narrower, a lesser braking force can be applied. The varying braking forces may be required for different weights of rolls or different types of materials.

In FIGS. 8–20 a modified embodiment of the present invention is disclosed. This embodiment includes a number of refinements not present in the embodiment of FIGS. 1–7. One refinement includes limiting the unwinding of the wind-up roller after the termination of braking, whereby the brake band will maintain a limited drag on the roll of cloth to prevent the cloth roll from speeding up excessively. In addition, provision is made for taking up the slack in the brake band after a certain amount of cloth has been removed from the cloth roll. Furthermore, the anchored end of the brake band is mounted on a pivotal frame to cause the brake band to extend at a tangent to the cloth roll at its initial point of contact therewith, regardless of the size of the cloth roll.

Figure 8:
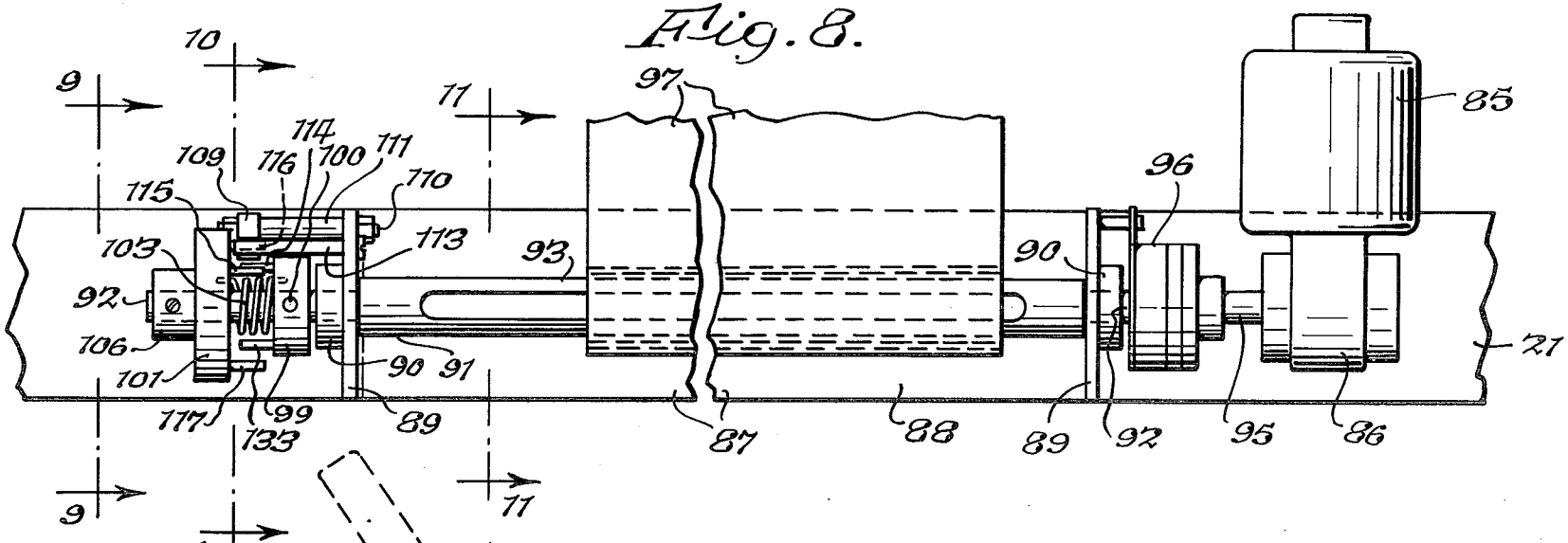
FIG. 8 is a side elevational view similar to FIG. 5 but showing an alternate embodiment of the wind-up roller construction.

In FIG. 8 motor 85 having gear reducer 86 associated therewith is shown mounted on edge control platform 21 of the cloth-laying machine. An U-shaped bracket 87 includes a base 88 suitably affixed to the frame of edge control platform 21. Legs 89 of bracket 87 mount bearings 90 which in turn journal pintles 92 (FIG. 12) which carry wind-up roller 93 of wind-up roller assembly 91. As can be seen from FIG. 12, each pintle 92 mounts a plug 94 to which the end of roller 93 is secured. Wind-up roller 93 is driven by output shaft 95 of gear reducer 86 through selectively energizable clutch 96, which may be identical to clutch 53 described above relative to FIGS. 1–7. In fact, all elements of structure associated with the wind-up roller assembly 91 may be identical to that shown in FIGS. 1–7 except for the mechanism at the left of FIG. 8 for providing limited loosening of brake band 97, as will be described in greater detail hereafter, and the structure for anchoring the end of the brake band to the frame.

Figure 11:
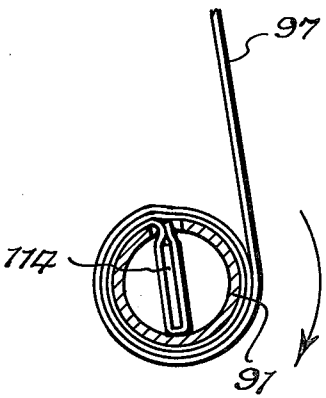
FIG. 11 is a fragmentary cross sectional view taken substantially along line 11—11 of FIG. 8.

Whenever motor 85 is energized, wind-up roller 93 will be rotated in the direction of the arrow shown in FIG. 11. Motor 85 may be energized in response to the action of dancer bar 31, as described in detail above, or in response to the actuation of switch 80 at machine reversal. In addition, motor 85 may be energized when the slack in brake band 97 reaches a predetermined amount, as will be described in greater detail hereafter.

Figure 9:
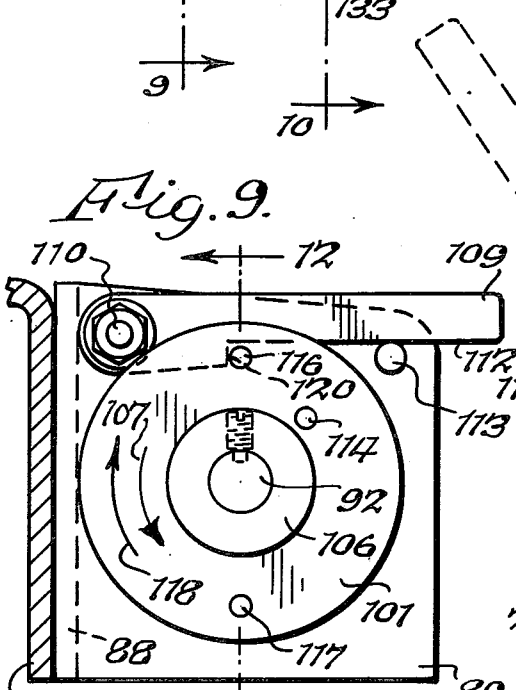
FIG. 9 is a fragmentary cross sectional view taken substantially along line 9—9 of FIG. 8 and showing the mechanism associated with the wind-up roller for permitting the brake band to be loosened a small amount after braking has been terminated.
Figure 12:
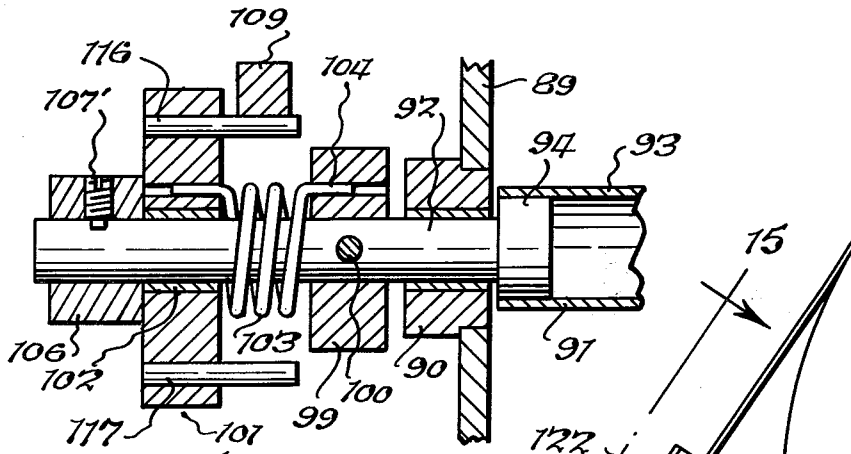
FIG. 12 is a fragmentary cross sectional view taken substantially along line 12—12 of FIG. 9.

Structure is provided at the left end of wind-up roller assembly 91 in FIG. 8 for providing a certain amount of slack in brake band 97 after braking has been terminated. In this respect, fixedly secured to pintle 92 by a pin 100 is disc 99. A second disc 101 is journalled on pintle 92 by bearing 102 (FIG. 12). A torsion spring 103 has one end 104 affixed within a bore in disc 99 and its opposite end 105 received in a bore in disc 101. A sleeve 106 is secured to pintle 92 by means of set screw 107' to retain disc 101 in axial position on pintle 92. Spring 103 biases disc 101 in the direction of arrow 107 (FIG. 9).

Pivotally mounted on the left bracket 89 (FIG. 8) is a pawl 109. More specifically, pawl 109 is mounted on pin 110 which is suitably secured to leg 89. A spacer sleeve 111 maintains pawl 109 in proper axial position relative to leg 89. Nuts (not numbered) maintain the pawl in assembled relationship with its supporting structure. Pawl 109 is movable between its dotted line inactive position (FIG. 10) to its solid line active position wherein it rests on pin 113 extending outwardly from bracket leg 89.

Figure 10:
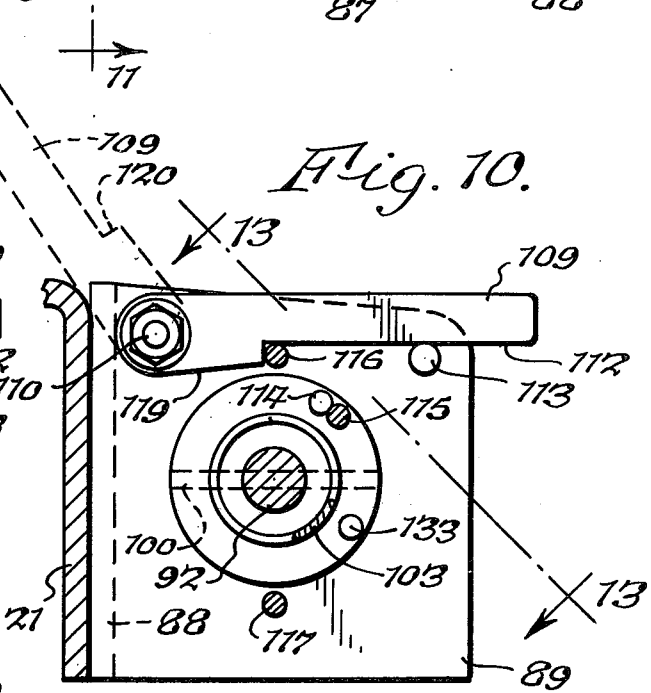
FIG. 10 is a fragmentary cross sectional view taken substantially along line 10—10 of FIG. 8 and showing the relationship between certain parts of the brake band loosening mechanism.

The end of band 97 (FIG. 11) has a bar 114 attached thereto which is selectively received in wind-up roller 93. Bar 114 and its associated slot are analogous to bar 57 and slot 56 of FIGS. 1–7. Whenever motor 85 is energized, wind-up roller 91 and all parts mounted thereon, will rotate in the direction of arrow 118 (FIG. 9). In this respect, pin 114, which extends outwardly from disc 99, engages pin 115 (FIG. 10) which extends outwardly from disc 101 so that disc 101 rotates in unison with disc 99. Pins 114 and 115 are normally in engagement, as shown in FIG. 10, because of the biasing action of spring 103. During this rotation pins 116 and 117, which are spaced 180° apart on disc 101, will periodically move up under surface 119 of pawl 109 and raise it to the position shown in FIG. 18. As soon as each pin 116 or 117 passes to the right beyond step 120 of pawl 109 in FIG. 18, pawl 109 will drop to the positions shown in FIGS. 9, 10 and 19. The purpose of step or shoulder 120 is to prevent pins 116 and 117 from moving in the direction of arrow 107 of FIG. 9 after either one of these pins has engaged step 120. This, of course, will also prevent disc 101 from moving in the direction of arrow 107 when either one of pins 116 or 117 attached thereto are in the positions of FIGS. 9 and 10.

Figure 14:
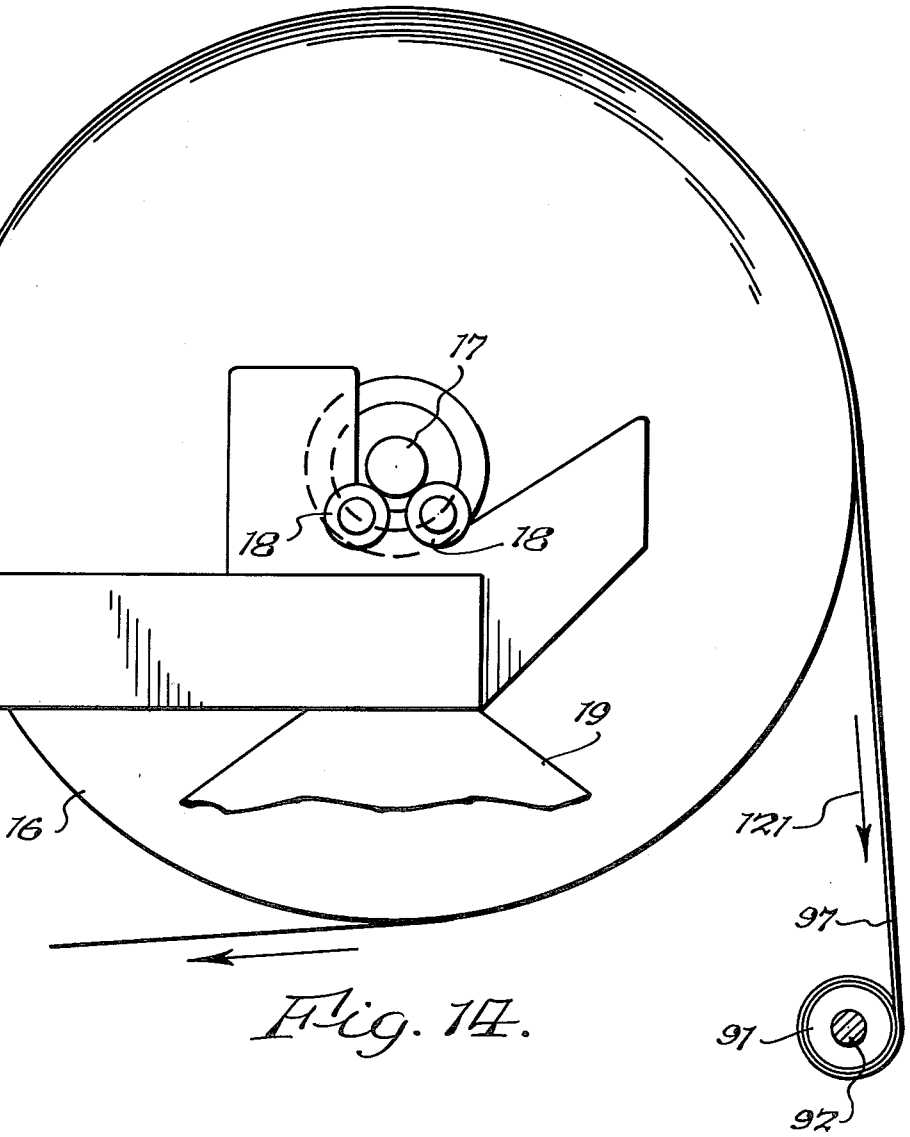
FIG. 14 is a side elevational view of the cloth roll with the braking mechanism shown in relation thereto and showing particularly the mechanism for anchoring the fixed end of the brake band.

The winding of brake band 97 onto roller 91 will cause band 97 to move in the direction of arrow 121 (FIG. 14). The end of brake band 97 remote from wind-up roller 91 is anchored onto rod 122, the opposite ends of which ride in slots 123 (FIG. 14) and 124 (FIG. 17) on the opposite sides of pivotable frame member 125. An U-shaped bracket 126 (FIG. 15) has a base 127 which is fixedly secured to frame member 43 of the edge control platform. Legs 129 extend outwardly from base 127 and mount bearing members 130 which pivotally support frame 125. As can best be visualized from FIG. 14, because frame 125 is pivotable, the portion of the brake band extending therefrom which first contacts the periphery of the cloth roll will lie at a tangent thereto, regardless of the diameter of the cloth roll.

After motor 85 has been actuated to effect braking by rotating wind-up roller 93, rod 122 (FIG. 16) will be pulled to the top of slots 123 and 124 against the bias of springs 131 so that the force of brake band 97 will be exerted against the periphery of the cloth roll 16. However, the amount of force which is applied will depend on the setting of clutch 96. In this respect, the torque of clutch 96 can be preset as required for the cloth being unwound. In other words, with certain types of cloth it may be desired to have a higher braking force, in which event clutch 96 will be set to slip at a higher torque. Conversely, if the cloth is to be braked with a lower force, clutch 96 is set to slip at a lower torque. Clutch 96 is preferably of the magnetic type wherein the slipping torque can be adjusted by varying the voltage applied to the clutch, although adjustable mechanical clutches may be used.

Figure 13:
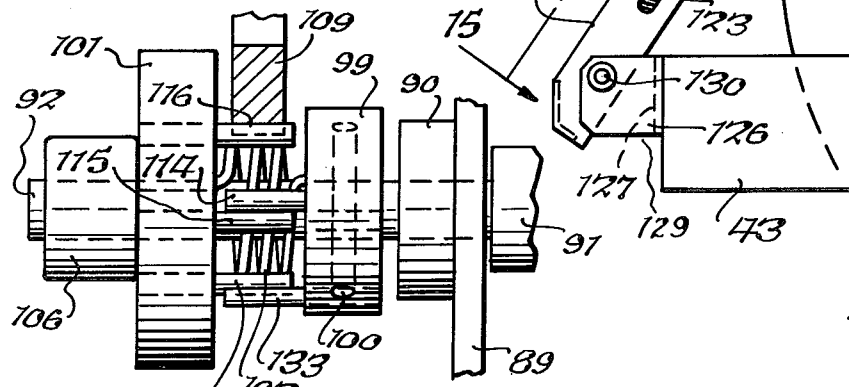
FIG. 13 is a fragmentary cross sectional view taken substantially along line 13—13 of FIG. 10.
Figure 18:
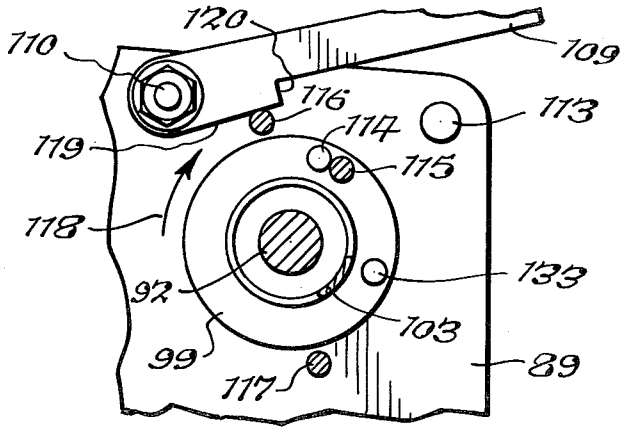
FIG. 18 is a fragmentary cross sectional view similar to FIG. 10 but showing the action of the pawl during the winding action of the wind-up roller.
Figure 19:
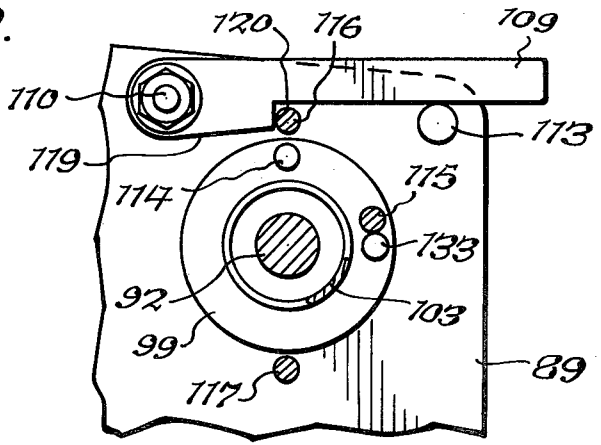
FIG. 19 is a fragmentary cross sectional view similar to FIG. 18 but showing the position of various parts of the wind-up roller after it has unwound a predetermined amount to provide a certain amount of slack for the brake band.
Figure 20:
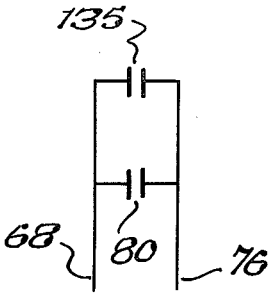
FIG. 20 is a partial view showing how the electrical circuit of FIG. 3 is modified for functioning with the embodiment of FIGS. 8–20.
Figure 15:
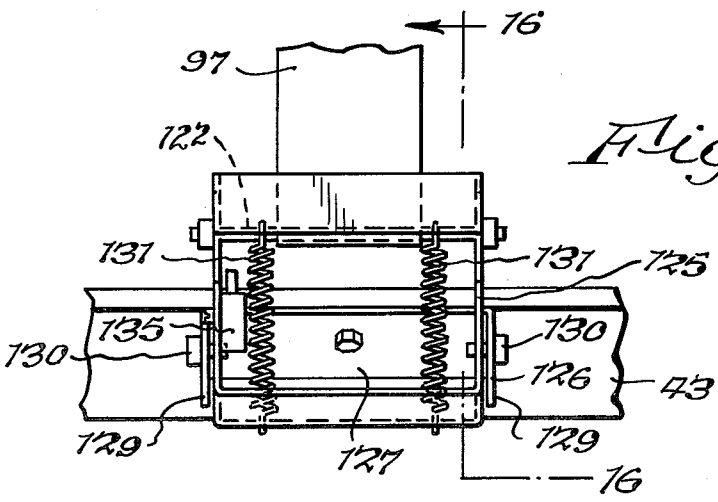
FIG. 15 is a view taken substantially in the direction of arrows 15—15 of FIG. 14 and showing constructional details of the anchoring mechanism for the brake band.

As explained above relative to FIGS. 1–7, whenever braking is required, the circuit controlling operation of the motor 85 will be energized for a predetermined time period, as governed by variable time delay relay 67. After energization of motor 85 and clutch 96 has been terminated (in a manner analogous to the termination of operation of motor 50 and clutch 53 of FIG. 3), clutch 96 will be permitted to run free, that is, roller 93 will be free to pivot relative to bracket legs 89. At this time a predetermined amount of unwinding of roller 93 will be produced. In this respect, springs 131, which are attached between rod 122 and portion 132 of frame 125, will pull rod 122 downwardly from the position shown in FIG. 16 toward the position shown in FIG. 17. As a result, the wind-up roller 93 and all parts at the left end thereof will pivot as a unit in the direction of arrow 107 (FIG. 9) until either one of pins 116 or 117 engage step 120 of pawl 109, whereupon further rotation of disc 101 in a counterclockwise direction is prevented. However, at this time pin 114 of disc 101 and pin 115 of disc 99 will be in the position shown in FIG. 10, inasmuch as they are normally biased to this position by spring 103. However, the force of springs 131 (FIG. 15) is greater than the force of torsion spring 103 (FIGS. 12 and 13). Therefore, spring 131 will cause wind-up roller 91 and disc 99 attached thereto to rotate in the direction of arrow 107 (FIG. 9) until pin 133 of disc 99 engages pin 115 (FIG. 19), at which time there can be no further rotation of disc 99. As can best be seen from FIG. 19, pins 114 and 133 of disc 99 are approximately 90° apart, and therefore wind-up roller portion 93 can back off or rotate approximately 90° in the direction of arrow 107 (FIG. 9) before pin 133 engages pin 115. This will provide a loosening effect on brake band 97 but will not permit it to unwind beyond the point at which pin 133 engages pin 114. It is to be noted that disc 99 will pivot a total of approximately 90°, that is, an amount equivalent to the movement of pin 133 from the position of FIG. 10 to the position of FIG. 19, whenever clutch 96 is disengaged when pin 116 or 117 is adjacent step 120, as shown relative to pin 116 in FIGS. 9, 10 and 19. However, it may well be that the clutch 96 will be disengaged when pin 116 is in the position shown in FIG. 18. In this situation, the disc 101 will rotate as a unit with roller 93 in the direction of arrow 107, as a result of the contraction of springs 133, until pin 117 engages step 120 of pawl 109. This movement will provide a rotation 180° to wind-up roller 93 in the direction of arrow 107. Thereafter, roller 91 will pivot 90° until pin 133 engages pin 115, that is, pin 133 will move from its position away from pin 115 until it engages pin 115, assuming that anchoring rod 122 has not bottomed. Thus, the maximum amount of back movement of roller 93 is approximately 270° and the minimum amount of movement is 90°, as described in detail above. However, most of the time the unwinding movement of roller 93 is between 90° and 270°, as clutch 96 may be disengaged at any position of pins 116 and 117. The loosening of the band brake in the foregoing manner is necessary in order to prevent the tightened band brake from interfering with normal operation of the cloth-laying machine, as for instance the removal of cloth from the roll during normal travel of the machine on the cloth-laying table and during reversal of the machine at the end of its travel when cloth is being tucked.

The parameters of the machine are set up so that under most operating conditions the rod 122 (FIGS. 15, 16 and 17) will be suspended between the ends of slots 123 and 124 so that there will be a drag on the cloth roll by brake band 97, with the amount of drag being governed by the tension of springs 131. In other words, rod 122, under most operating conditions, will float in slots 123 and 124 under the bias of springs 131, and will assume a position somewhere between the end positions shown in FIGS. 16 and 17. In this respect, springs 131 with a pull of 16 pounds per inch have been used. Since there are two springs and since the springs are generally stretched about an inch during machine operation, there is approximately a 30-pound pull on brake band 97. Thus, when rod 122 is floating in slots 123 and 124, the operating parameters cause a slight drag to be applied to the roll by brake band 97 to prevent the cloth roll 16 from speeding up. However, it is to be noted that the primary braking effect on roll 16 is achieved by varying the time that the brake is applied and by applying a greater pull to brake band 97 during energization of the wind-up motor. In this respect, the time is varied to an amount up to 5 seconds and the torque which is applied through clutch 96 is sufficient to pull rod 22 to the tops of slots 23 and 24 before clutch 96 slips. However, the clutch can be adjusted to slip before rod 22 reaches the tops of slots 22 and 23 if the latter condition would create too much braking. It will be appreciated, as noted above, that the actual amount of braking which is applied will therefore depend on the foregoing factors and the cross sectional area of the brake band 97 which engages the outer surface of the cloth roll 16.

Figure 17:
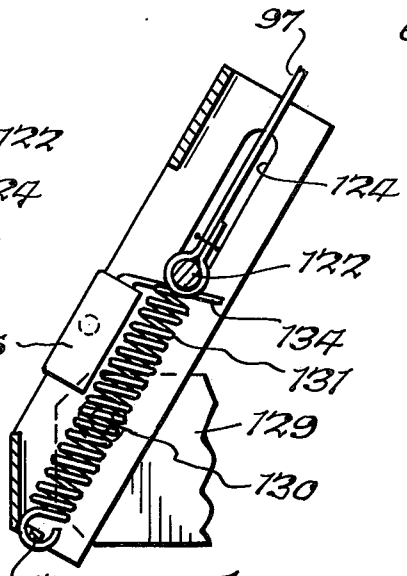
FIG. 17 is a fragmentary cross sectional view similar to FIG. 16 but showing the position of the parts of the anchoring mechanism when the band brake experiences its greatest amount of slack.
Figure 16:
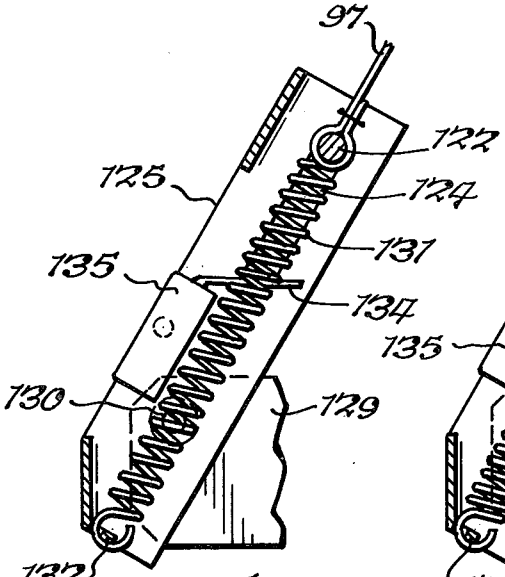
FIG. 16 is a fragmentary cross sectional view taken substantially along line 16—16 of FIG. 15 and showing the position of the anchoring mechanism during braking.

Whenever anchoring rod 122 reaches the bottom of slots 123 and 124, as shown in FIG. 17, there is an indication that brake band 97 is too loose. This looseness may be due to the fact that a very large amount of cloth was unwound from roll 16. In the foregoing situation, after rod 122 has reached the position shown in FIG. 17, it will engage arm 134 of switch 135 which is mounted on pivotable bracket 125. Switch 135 is located in parallel to switch 80 (FIG. 20) and therefore, when closed, will energize drive motor 85 and clutch 96, and at the same time other switches in the circuit (not shown) will deenergize feed roll clutch 70. This will cause motor 85 to wind up brake band 97, as described in detail above, for a predetermined time period depending on the setting of time delay relay 67. At this point it is to be noted, as expressed briefly above, that the only basic difference between the wind-up roller assembly 91 of FIG. 8 and that shown in FIGS. 1–7 resides in the limited release assembly shown at the left of FIG. 8 for causing the brake band to maintain a slight drag on the cloth roll after the termination of primary braking.

During the operation of the cloth-laying machine, the brake mechanism will be selectively energized. As noted above, this energization occurs whenever switch 60 is actuated by dancer bar 31, or whenever the machine is reversing as a result of switch 80 engaging dog 81, or whenever anchoring rod 122 moves into engagement with switch arm 134. Thus, a plurality of conditions can exist whenever motor 85 is actuated to effect braking. In this respect, as noted above, braking will occur for a predetermined time period, as determined by the setting of variable time relay 67. After the termination of this time period, clutch 96 will release and springs 131 will contract.

While the roll on the cloth-laying machine has been referred to as mounting a roll of cloth, it will be appreciated that any type of fabric or planar sheet material is intended and that the term fabric in the claims is intended to encompass all types of planar flexible sheet materials which are conventionally wound in roll form.

While preferred embodiments of the present invention have been disclosed, it will be appreciated that the present invention is not limited thereto but may be otherwise embodied within the scope of the following claims.

What is claimed is:

1. A brake construction for braking a roll of fabric journalled on a cloth-laying machine comprising a machine frame having first and second frame portions spaced circumferentially of said roll, brake band means having first and second spaced band portions with an intermediate band portion therebetween, first means for attaching said first band portion to said first frame portion, second means for attaching said second band portion to said second frame portion, and motor means for selectively moving said intermediate band portion against said roll to effect braking thereof.

2. A brake construction as set forth in claim 1 wherein said brake band means comprises a band of flexible material and wherein said second means comprises a wind-up roller mounted on said second frame portion.

3. A brake construction as set forth in claim 2 wherein said motor means are coupled to said wind-up roller for pulling said second band portion away from said first band portion.

4. A brake construction as set forth in claim 3 wherein said wind-up roller includes first connecting means and wherein said second band portion includes second connecting means for selective attachment and detachment to said first connecting means.

5. A brake construction as set forth in claim 4 wherein said first connecting means comprises a slot in said wind-up roller, and wherein said second connecting means comprises a bar attached to said second band portion for reception in said slot.

6. A brake construction as set forth in claim 1 wherein said first means comprises spring means effectively connecting said first band portion to said first frame portion.

7. A brake construction as set forth in claim 6 including a pivotal frame for mounting said spring means.

8. A brake construction as set forth in claim 6 wherein said motor means are coupled to said second band portion.

9. A brake construction as set forth in claim 8 including clutch means effectively interposed between said motor means and said second band portion.

10. A brake construction as set forth in claim 9 wherein said clutch means is of a strength which permits said motor means to stress said spring means when said clutch means is engaged, and when said clutch means is disengaged said spring means will return to a more unstressed condition to thereby relieve the force of said brake band means on said roll.

11. A brake construction as set forth in claim 8 including wind-up roller means coupled to said motor means for receiving said second band portion, and means for permitting said wind-up roller means to unwind a limited amount under the bias of said spring means.

12. A brake construction as set forth in claim 1 including time delay means operatively associated with said motor means for permitting said motor means to be effectively energized only for a predetermined time period.

13. A brake construction as set forth in claim 12 including feed means on said machine frame for unwinding fabric from said roll, clutch means for driving said feed means, and disengaging means for disengaging said clutch means when said motor means are energized.

14. A brake construction as set forth in claim 13 including second clutch means effectively located between said motor means and said second band portion, and means for selectively causing said second clutch means to be engaged when said motor means are energized.

15. A brake construction as set forth in claim 1 including clutch means effectively interposed between said motor means and said second band portion.

16. A brake construction as set forth in claim 15 including means for selectively engaging said clutch means to cause said motor means to pull said second band portion, and means for selectively disengaging said clutch means to thereby terminate the braking effect of said intermediate band portion produced by said motor means.

17. A brake construction as set forth in claim 16 including feed means for unwinding fabric from said roll, second clutch means for driving said feed means, and means for disengaging said second clutch means when said clutch means are engaged.

18. A brake construction as set forth in claim 1 including first switch means for energizing said motor means in response to a predetermined amount of slack in the fabric leaving said roll, and second switch means for energizing said motor means in response to the slowing of said machine at reversal.

19. A brake construction as set forth in claim 18 wherein said second means includes a wind-up roller coupled to said motor means, and means for permitting said wind-up roller to unwind up to a predetermined amount upon effective deenergization of said motor means from driving relationship with said wind-up roller.

20. A brake construction as set forth in claim 18 including third switch means for energizing said motor means in response to a predetermined amount of slack in said brake band means.

21. A brake construction as set forth in claim 20 wherein said second means includes a wind-up roller coupled to said motor means, and means for permitting said wind-up roller to unwind up to a predetermined amount upon effective deenergization of said motor means from driving relationship with said wind-up roller.

22. A brake construction as set forth in claim 1 including switch means for causing said motor means to pull said intemediate band portion against said roll to effect braking in response to a predetermined amount of slack in the fabric leaving said roll.

23. A brake construction as set forth in claim 22 wherein said second means includes clutch means effectively interposed between said motor means and said second band portion.

24. A brake construction as set forth in claim 23 including means for disengaging said clutch means to terminate braking.

25. A brake construction as set forth in claim 24 including means for permitting movement of said brake band means toward said first frame portion upon disengagement of said clutch means.

26. A brake construction as set forth in claim 25 wherein said means for disengaging said clutch means comprises time delay means for causing said motor means to effect said braking for a predetermined time period.

27. A brake construction as set forth in claim 1 including switch means for causing said motor means to pull said intermediate band portion against said roll to effect braking in response to reversal of said machine.

28. A brake construction as set forth in claim 27 including clutch means effectively interposed between said motor means and said second band portion.

29. A brake construction as set forth in claim 28 including means for disengaging said clutch means to terminate braking.

30. A brake construction as set forth in claim 29 including means for permitting movement of said brake band means toward said first frame portion upon disengagement of said clutch means.

31. A brake construction as set forth in claim 30 wherein said means for disengaging said clutch means comprises time delay means for causing said motor means to effect said braking for a predetermined time period.

32. A brake construction as set forth in claim 1 including switch means for energizing said motor means to pull said second band portion away from said first band portion in response to the sensing of a predetermined amount of slack in said brake band means.

33. A brake construction as set forth in claim 32 wherein said second means includes clutch means effectively interposed between said motor means and said second band portion of said brake band means.

34. A brake construction as set forth in claim 33 including means for disengaging said clutch means to terminate pulling of said second band portion.

35. A brake construction as set forth in claim 34 including means for permitting movement of said brake band means toward said first frame portion upon disengagement of said clutch means.

36. A brake construction as set forth in claim 35 wherein said means for permitting movement comprises means for permitting limited movement of said brake band means toward said first frame portion.

37. A brake construction as set forth in claim 36 wherein said means for disengaging said clutch means comprises time delay means for causing said motor means to effect said braking for a predetermined time period.

38. A brake construction as set forth in claim 1 including means for causing said motor means to press said intermediate band portion against said roll with a first force for a period of time, and third means for causing said intermediate band portion to exert a second force on said roll after said period of time, said second force being smaller than said first force.

39. A brake construction as set forth in claim 38 including a winding roller coupled to said motor means, and wherein said third means comprises a limited-unwind mechanism for said winding roller.

40. A brake construction as set forth in claim 39 wherein said first means comprises a spring arrangement.

41. A brake construction as set forth in claim 40 including clutch means effectively located between said motor means and said winding roller.

42. A brake construction as set forth in claim 41 including a feed roller on said machine for unwinding said roll of fabric, second clutch means for driving said feed roller, and means for deenergizing said second clutch means when said clutch means are energized.

43. A brake construction as set forth in claim 42 including means for effectively energizing said motor to drive said winding roller in response to excessive looseness in the fabric leaving said roll.

44. A brake construction as set forth in claim 43 including means for effectively energizing said motor to drive said winding roller in response to excess slack of said brake band means.

45. A brake construction for braking a roll of fabric having an outer surface and journalled on a cloth-laying machine comprising a machine frame, unwinding means for unwinding fabric from said roll of fabric, brake band means on said frame, first means for causing said brake band means to engage said outer surface with a first force to effect braking of said roll, and second means for causing said brake band means to engage said outer surface with a second force which is smaller than said first force to provide a drag on said roll during operation of said unwinding means.

46. A brake construction as set forth in claim 45 including means for deactivating said unwinding means during activation of said first means.

* * * * *